US011761612B1

(12) United States Patent
Wang

(10) Patent No.: US 11,761,612 B1
(45) Date of Patent: Sep. 19, 2023

(54) FESTOON LAMP FENCE

(71) Applicant: Qiaoyan Wang, Taizhou (CN)

(72) Inventor: Qiaoyan Wang, Taizhou (CN)

(73) Assignee: Qiaoyan Wang, Taizhou (CN)

( * ) Notice: Subject to any disclaimer, the term of this patent is extended or adjusted under 35 U.S.C. 154(b) by 0 days.

(21) Appl. No.: 18/078,376

(22) Filed: Dec. 9, 2022

(51) Int. Cl.

| | |
|---|---|
| ***F21V 17/18*** | (2006.01) |
| ***F21V 23/06*** | (2006.01) |
| ***E04H 17/00*** | (2006.01) |
| ***F21V 33/00*** | (2006.01) |
| ***F21V 21/08*** | (2006.01) |

(52) U.S. Cl.
CPC ..... *F21V 17/18* (2013.01); *E04H 17/017* (2021.01); *F21V 21/0824* (2013.01); *F21V 23/06* (2013.01); *F21V 33/006* (2013.01)

(58) Field of Classification Search
CPC ..... F21V 17/18; F21V 21/082; F21V 23/06; F21V 33/006; E04H 17/017
See application file for complete search history.

(56) References Cited

U.S. PATENT DOCUMENTS

| | | | | |
|---|---|---|---|---|
| 1,794,467 A * | 3/1931 | Lucas | F21V 33/006 256/33 |
| 10,876,727 B1 * | 12/2020 | Xi | F21S 4/28 |
| 2003/0075712 A1 * | 4/2003 | Lin | E04H 17/017 256/1 |
| 2008/0099751 A1 * | 5/2008 | Chen | F21V 21/0824 256/19 |

FOREIGN PATENT DOCUMENTS

| | | | |
|---|---|---|---|
| CN | 201495513 U * | 6/2010 | F21S 9/03 |
| CN | 203868929 U | 10/2014 | |
| CN | 108222653 A * | 6/2018 | |
| CN | 209540567 U | 10/2019 | |
| CN | 215168718 U | 12/2021 | |
| CN | 218509187 U * | 2/2023 | |

OTHER PUBLICATIONS

Machine translation of CN-218509187-U (Year: 2023).*
Machine translation of CN-108222653-A (Year: 2018).*
Machine translation of CN-201495513-U (Year: 2010).*

* cited by examiner

*Primary Examiner* — Leah Simone Macchiarolo
(74) *Attorney, Agent, or Firm* — Nitin Kaushik

(57) ABSTRACT

The present disclosure provides an ornamental festoon lamp, and aims to provide a festoon lamp fence. The festoon lamp fence includes fence bodies and is formed by connecting the plurality of fence bodies. The fence bodies are connected to one another by a buckle connection portion. Each of the fence bodies includes a housing, a buckle plate, and a lamp string wire. A fixing seat is arranged on the fence bodies. The lamp string wire is arranged inside the housing. The buckle connection portion includes buckles arranged at one end of the housing and clamping grooves arranged at the other end of the housing. The buckles, the clamping grooves, the housings, and the buckle plates cooperate to form a wire outlet and a wire inlet. A connector configured to be connected to another lamp string wire is arranged at an end of the lamp string wire.

4 Claims, 4 Drawing Sheets

FESTOON LAMP FENCE

TECHNICAL FIELD

The present disclosure relates to the technical field of festoon lamps, and more specifically, to a festoon lamp fence.

BACKGROUND

Fences are widely used in our production and life, including garden fences, highway fences, municipal fences, etc. Private villas and courtyard fences are popular in many cities. They are mainly made of wooden boards, include fence boards, transverse band boards, and fence posts, have different shapes, and are mainly installed for decoration and simple protection in general. For beautification and illumination, people often install some festoon lamps on fences to form festoon lamp fences. Existing festoon lamp fences on the market have the following disadvantages: 1. Because the fence boards and the fence posts are connected in an integrated manner, larger space needs to be occupied during transportation or storage, which increases transportation and storage costs; and due to the integrated connection, damage is easily caused during transportation. 2. One lamp wire is used for decorative lighting of a festoon lamp fence, such that if one of parts is damaged, the whole lamp wire needs to be replaced and repaired, resulting in higher cost. 3. The festoon lamp fences are connected to each other by winding wire meshes, which leads to high difficulty in disassembly and reconnection. 4. Lamp wires are disorderly arranged in the festoon lamp fence, such that the lamp wires will fall off after a long time of use, thereby affecting the decorative lighting effect.

SUMMARY

In view of the deficiencies existing in the prior art, an objective of the present disclosure is to provide a festoon lamp fence.

To achieve the above objective, the present disclosure provides the following technical solution: a festoon lamp fence, including fence bodies, where the festoon lamp fence is formed by connecting the plurality of fence bodies, the fence bodies are connected to one another by a buckle connection portion, each of the fence bodies includes a housing, a buckle plate, and a lamp string wire, the buckle plate is connected to the housing via a combination portion of connecting columns, a fixing seat is arranged on the fence bodies, the fixing seat is arranged on the ground and configured to fix the fence bodies, and the lamp string wire is arranged inside the housing.

Further, the buckle connection portion includes buckles arranged at one end of the housing and clamping grooves arranged at the other end of the housing, the buckles include a first buckle arranged above the housing and a second buckle arranged below the housing, the clamping grooves include a first clamping groove arranged above the housing and a second clamping groove arranged below the housing, the first buckle is cooperatively connected to the first clamping groove, and the second buckle is cooperatively connected to the second clamping groove.

Further, a wire outlet is cooperatively formed at a joint of the second buckle, the corresponding housing, and the corresponding buckle plate, a wire inlet is cooperatively formed at a joint of the second clamping groove, the corresponding housing, and the corresponding buckle plate, a connector configured to be connected to another lamp string wire is arranged at an end of the lamp string wire, the lamp string wire is clamped and connected to the wire outlet and the wire inlet, and the wire outlet and the wire inlet are configured to limit the lamp string wire.

Further, the combination portion of connecting columns includes connecting grooves arranged in the housing and connecting columns arranged on the buckle plate, the connecting columns are inserted into the connecting grooves, and the combination portion of connecting columns is configured to fixedly connect the buckle plate to the housing.

Further, the fixing seat is detachably connected to the fence bodies, a clamping and connecting groove configured to sleeve the corresponding fence body is arranged on the fixing seat, and the fixing seat is set to be a ground inserted bar capable of being inserted into the ground or a stable base capable of being placed on the ground.

Further, limit grooves are arranged in the housing, the limit grooves and the connecting grooves are arranged in the housing at intervals and are together configured to limit the lamp string wire, and an outer diameter of the connecting grooves is larger than a groove width of the limit grooves.

By adopting the above technical solution, the present disclosure has the following beneficial effects: 1. The fixing seat is detachably connected to the fence bodies, such that the fixing seat may be disassembled during transportation and storage and then is installed when the festoon lamp fence is actually installed, thereby saving transportation and storage space and reducing costs. 2. One lamp string wire is arranged in each fence body, and after the fence body is connected, the lamp string wire therein is connected to another lamp string wire via the connector, which may ensure that the whole festoon lamp fence will not be affected during maintenance after one of the lamp string wires is damaged. 3. The adjacent festoon lamp fence bodies are connected to each other via the buckle connection portion, such that the festoon lamp fence is easy to install and convenient to disassemble, and may be installed or disassembled according to an outdoor condition. 4. The connecting groove and the limit groove arranged inside the housing may fix the position of the lamp string wire, thereby ensuring stable and orderly arrangement of the lamp string wire therein. 5. The lamp string wires extend from the wire outlet and enter from the wire inlet, which may ensure stable connection of the festoon lamp fence.

BRIEF DESCRIPTION OF DRAWINGS

FIG. 4 is a schematic structural diagram of Embodiment 2 of a festoon lamp fence in the present disclosure, in which:

1: fence body; 2: housing; 3: buckle plate; 4: lamp string wire; 5: ground inserted bar; 6: first buckle; 7: second buckle; 8: first clamping groove; 9: second clamping groove; 10: wire outlet; 11: wire inlet; 12: connecting groove; 13: connecting column; 14: limit groove; 15: fence plate housing; 16: transverse plate housing; and 17: stable base.

DETAILED DESCRIPTION OF THE EMBODIMENTS

Figure 1:
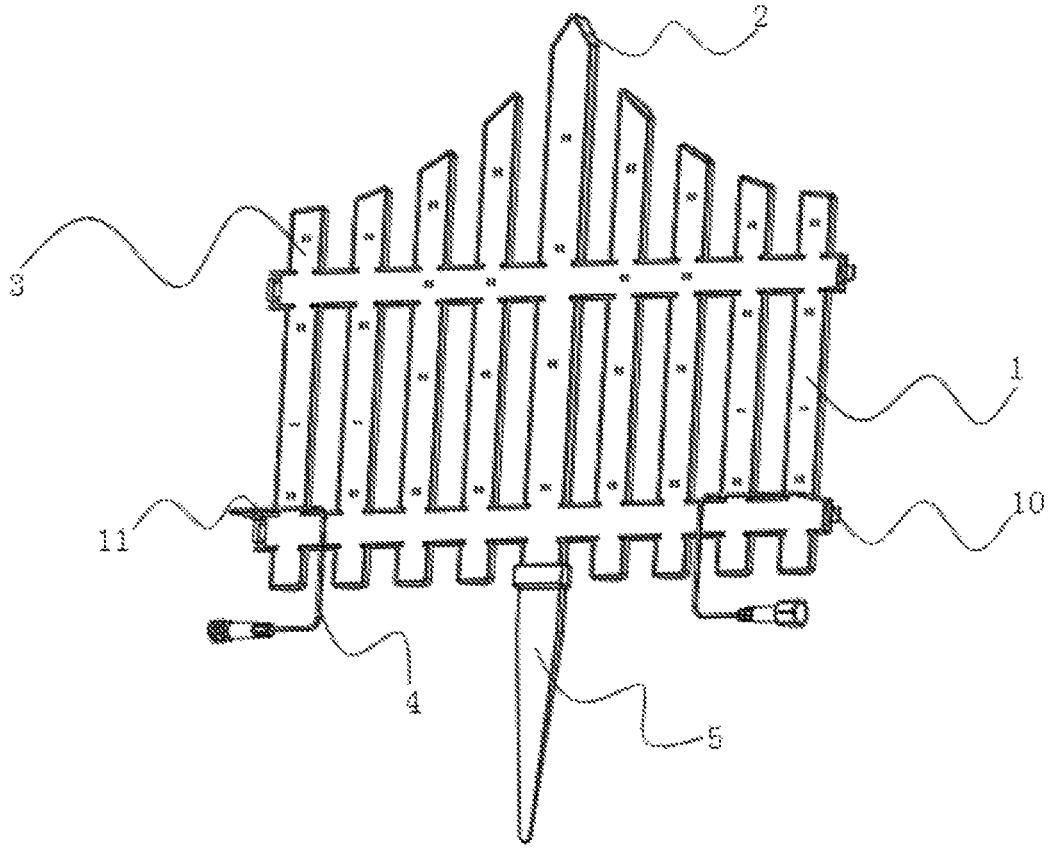
FIG. 1 is a schematic structural diagram of Embodiment 1 of a festoon lamp fence in the present disclosure.
Figure 2:
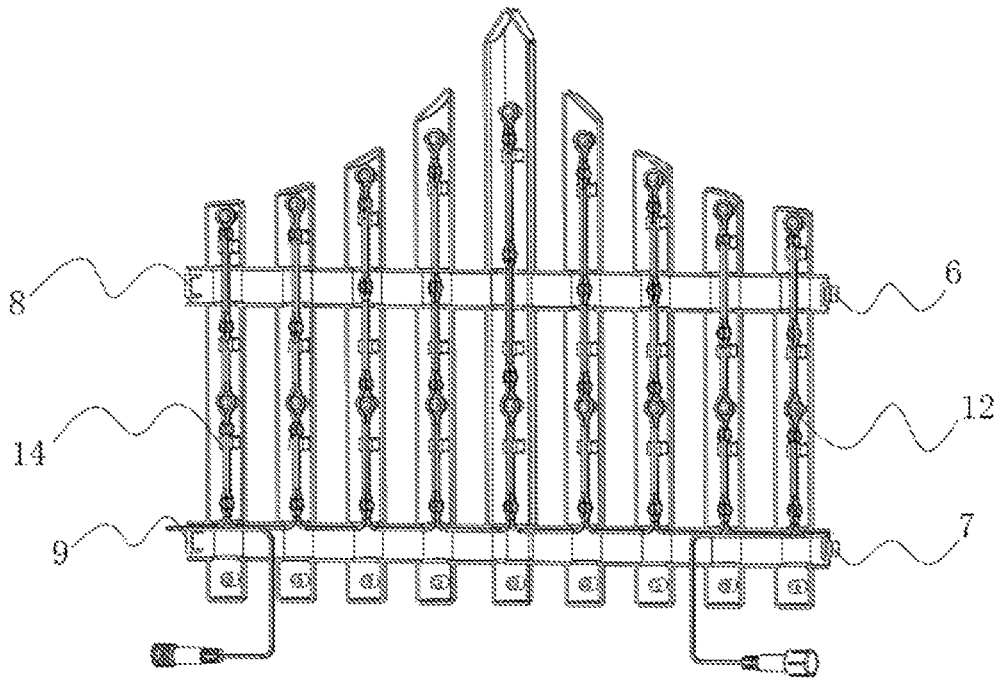
FIG. 2 is a schematic structural diagram of an interior of a lamp housing.
Figure 3:
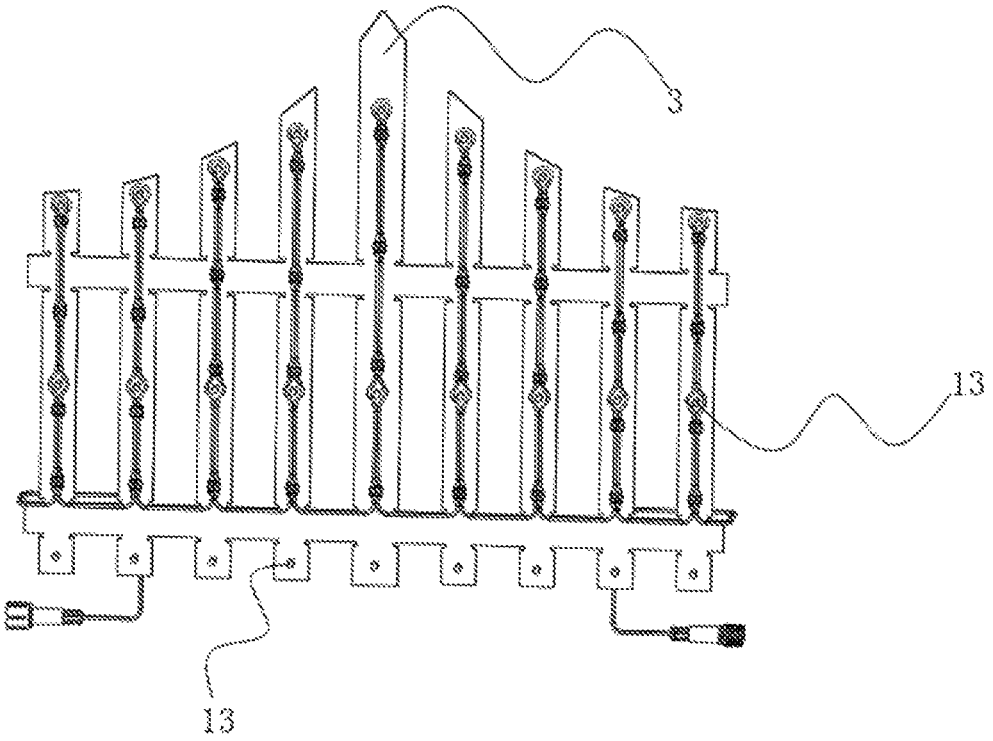
FIG. 3 is a schematic structural diagram of a buckle plate.
Figure 4:
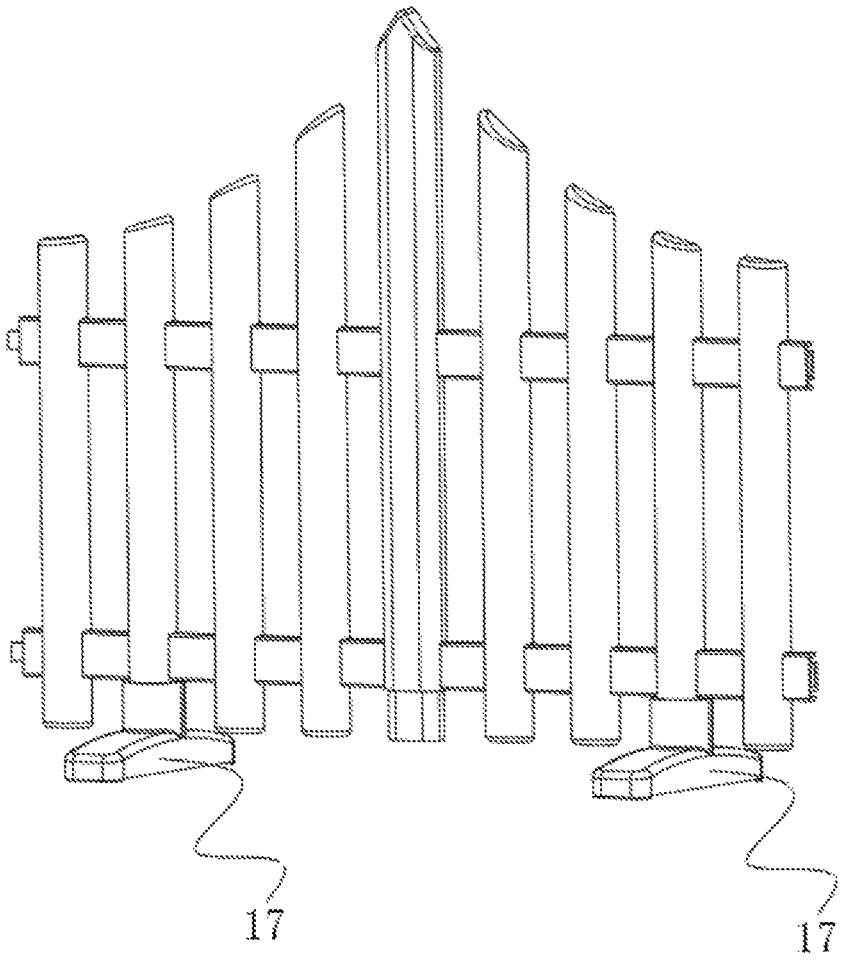

The embodiments of a festoon lamp fence in the present disclosure are further described with reference to FIG. 1 to FIG. 4.

For ease of explanation, the relative spatial terms such as "up", "down", "left", and "right" are used in the embodiments to explain the relationship between one element or feature and another element or feature shown in the figure. It should be understood that in addition to the orientations shown in the figure, the spatial terms are intended to include different orientations of the device in use or operation. For example, if the apparatus in the figure is inverted, the element described as being positioned "below" other element or feature will be positioned "above" other element or feature. Therefore, the exemplary term "below" may include both an upper and a lower orientation. The apparatus may be positioned in other way (rotated 90° or positioned in other orientation), and the relative spatial description used here may be explained accordingly.

Moreover, the relational terms such as "first" and "second" are only used for distinguishing one component with the same name from another, and do not necessarily require or imply any such actual relationship or order between these components.

Embodiment 1

A festoon lamp fence includes fence bodies 1. The festoon lamp fence is formed by connecting the plurality of fence bodies 1. The fence bodies 1 are connected to one another via a buckle connection portion. Each fence body 1 includes a housing 2, a buckle plate 3, and a lamp string wire 4. The buckle plate 3 is connected to the housing 2 via a combination portion of connecting columns 13. A fixing seat is arranged on the fence bodies 1. The lamp string wire 4 is arranged inside the housing 2. The housing 2 includes a fence plate housing 15 and a transverse plate housing 16. The fixing seat is arranged below the middle of the fence plate housing 15. The fixing seat is set to be a ground inserted bar 5 shaped like an inverted triangle. A clamping and connecting groove configured to sleeve the housing 2 is arranged on the ground inserted bar 5. After the buckle plate 3 is matched with the housing 2, the ground inserted bar 5 is sleeved at the bottom of the housing via the clamping and connecting groove. When the festoon lamp fence is used, the ground inserted bar 5 is inserted into a deep position of the ground, and then the festoon lamp fence is connected to the ground inserted bar 5 via the clamping and connecting groove. The ground inserted bar 5 may ensure the stability of the festoon lamp fence.

The buckle connection portion includes buckles arranged atone end of the housing 2 and clamping grooves arranged at the other end of the housing 2. The buckles include a first buckle 6 arranged above the housing 2 and a second buckle 7 arranged below the housing 2. The clamping grooves include a first clamping groove 8 arranged above the housing 2 and a second clamping groove 9 arranged below the housing 2. The first buckle 6 is cooperatively connected to the first clamping groove 8, and the second buckle 7 is cooperatively connected to the second clamping groove 9. The buckles and the clamping grooves are arranged at ends of the transverse plate housing 16 and are cooperatively connected to each other. A wire outlet 10 is cooperatively formed at a joint of the second buckle 7, the corresponding housing 2, and the corresponding buckle plate 3. A wire inlet 11 is cooperatively formed at a joint of the second clamping groove 9, the corresponding housing 2, and the corresponding buckle plate 3. A connector configured to be connected to another lamp string wire 4 is arranged at an end of the lamp string wire 4. The lamp string wire 4 is clamped and connected to the wire outlet 10 and the wire inlet 11. The wire outlet 10 and the wire inlet 11 are configured to limit the lamp string wire 4.

The combination portion of connecting columns 13 includes connecting grooves 12 arranged in the housing 2 and connecting columns 13 arranged on the buckle plate 3. The connecting columns 13 are inserted into the connecting grooves 12. The combination portion of connecting columns 13 is configured to fixedly connect the buckle plate 3 to the housing 2. Limit grooves 14 are arranged in the housing 2. The limit grooves 14 and the connecting grooves 12 are arranged in the housing 2 at intervals and are together configured to limit the lamp string wire 4. An outer diameter of the connecting grooves 12 is larger than a groove width of the limit grooves 14. According to a path of arranging the lamp string wire 4 in the housing, the lamp string wire enters the housing 2 via the wire inlet 11 first and then is sequentially arranged in each fence plate housing 15. The three limit grooves 14 and connecting grooves 12 are arranged in each fence plate housing 15. After entering one limit groove 14, the lamp string wire 4 continues to enter the next limit groove 14 by making a half circle around an outer wall of the connecting groove 12, then returns the same way by making a full circle around the outer wall of the connecting groove 12 after entering the limit groove 14 again, and enters the next fence plate housing 15. This wire winding route continues being repeated. Since the outer diameter of the connecting grooves 12 is larger than the groove width of the limit grooves 14, the limit grooves 14 may limit and clamp the lamp string wire 4 that passes through the connecting grooves 12 by means of wire winding, which may ensure that the lamp string wire 4 is stably arranged in the housing and will not fall off due to shaking of the fence.

Embodiment 2

This embodiment with roughly the same arrangement as Embodiment I has the only difference that the fixing seat is set to be a stable base 17, the stable base 17 has a flat bottom surface, and a clamping and connecting groove adapted to the housing 2 is arranged on a top surface of the stable base. When the festoon lamp fence is actually installed, the stable base 17 is arranged on the ground first and then the installed housing 2 and buckle plate 3 are together inserted into the clamping and connecting groove of the stable base 17. The stable base 17 may ensure that the festoon lamp fence will not topple over, and may enhance the connection stability of the housing 2 and the buckle plate 3.

The above are only the preferred embodiments of the present disclosure, and are not intended to limit the present disclosure. Common changes and substitutions made by those skilled in the art within the scope of the technical solution of the present disclosure should be included in the scope of protection of the present disclosure.

What is claimed is:

1. A festoon lamp fence, comprising fence bodies, wherein the festoon lamp fence is formed by connecting the plurality of fence bodies, the fence bodies are connected to one another by a buckle connection portion, each of the fence bodies comprises a housing, a buckle plate, and a lamp string wire, the buckle plate is connected to the housing via a combination portion of connecting columns, a fixing seat is arranged on the fence bodies, the fixing seat is arranged on the ground and configured to fix the fence bodies, and the lamp string wire is arranged inside the housing, the combination portion of connecting columns comprises connecting grooves arranged in the housing and connecting columns arranged on the buckle plate, the connecting columns are inserted into the connecting grooves, and the combination portion of connecting columns is configured to fixedly connect the buckle plate to the housing, limit grooves are arranged in the housing, the limit grooves and the connecting grooves are arranged in the housing at intervals and are together configured to limit the lamp string wire, and an outer diameter of the connecting grooves is larger than a groove width of the limit grooves.

2. The festoon lamp fence according to claim 1, wherein the buckle connection portion comprises buckles arranged at one end of the housing and clamping grooves arranged at the other end of the housing, the buckles comprise a first buckle arranged above the housing and a second buckle arranged below the housing, the clamping grooves comprise a first clamping groove arranged above the housing and a second clamping groove arranged below the housing, the first buckle is cooperatively connected to the first clamping groove, and the second buckle is cooperatively connected to the second clamping groove.

3. The festoon lamp fence according to claim 2, wherein a wire outlet is cooperatively formed at a joint of the second buckle, the corresponding housing, and the corresponding buckle plate, a wire inlet is cooperatively formed at a joint of the second clamping groove, the corresponding housing, and the corresponding buckle plate, a connector configured to be connected to another lamp string wire is arranged at an end of the lamp string wire, the lamp string wire is clamped and connected to the wire outlet and the wire inlet, and the wire outlet and the wire inlet are configured to limit the lamp string wire.

4. The festoon lamp fence according to claim 1, wherein the fixing seat is detachably connected to the fence bodies, a clamping and connecting groove configured to sleeve the corresponding fence body is arranged on the fixing seat, and the fixing seat is set to be a ground inserted bar capable of being inserted into the ground or a stable base capable of being placed on the ground.

* * * * *